US009603494B1

(12) United States Patent
Wang et al.

(10) Patent No.: US 9,603,494 B1
(45) Date of Patent: Mar. 28, 2017

(54) FOAMED SOAP DISPENSING STRUCTURE

(71) Applicants: Hsiang-Hung Wang, Changhua (TW); Yu-Chang Lin, Changhua (TW)

(72) Inventors: Hsiang-Hung Wang, Changhua (TW); Yu-Chang Lin, Changhua (TW)

(73) Assignee: Hsiang-Hung Wang, Changhua (TW)

( * ) Notice: Subject to any disclaimer, the term of this patent is extended or adjusted under 35 U.S.C. 154(b) by 0 days.

(21) Appl. No.: 14/932,982

(22) Filed: Nov. 5, 2015

(51) Int. Cl.
*A47K 5/14* (2006.01)
*A47K 5/12* (2006.01)
*B05B 11/00* (2006.01)

(52) U.S. Cl.
CPC ..... *A47K 5/14* (2013.01); *A47K 5/1211* (2013.01); *A47K 5/1217* (2013.01); *B05B 11/3087* (2013.01)

(58) Field of Classification Search
CPC ..... A47K 5/14; A47K 5/1211; A47K 5/1217; B05B 11/3087
USPC ..... 222/190, 630
See application file for complete search history.

(56) References Cited

U.S. PATENT DOCUMENTS 5,836,482 A * 11/1998 Ophardt ..... A47K 5/1217 222/181.1
7,819,289 B2 * 10/2010 Willis ..... A47K 5/14 222/135
2006/0011655 A1 * 1/2006 Ophardt ..... A47K 5/16 222/190
2009/0101679 A1 * 4/2009 Muderlak ..... A47K 5/16 222/375
2013/0032614 A1 * 2/2013 Babikian ..... B01F 5/0693 222/190
2014/0124540 A1 * 5/2014 Ciavarella ..... A47K 5/14 222/190
2014/0263421 A1 * 9/2014 Urban ..... A47K 5/12 222/23

* cited by examiner

*Primary Examiner* — Donnell Long
(74) *Attorney, Agent, or Firm* — Yuwen Guo

(57) ABSTRACT

A foamed soap dispensing structure comprises a container, a cover set, a faucet, and a foaming unit. The foaming unit has a foaming member and an outer ring. The foaming member has two inlets and a foam material. The outer ring has an assembling end corresponding to a connection end of a soap providing portion of the faucet. When the foaming unit is clogged, the foaming unit may be pulled out by an user so that the assembling end may be separated from the connection end of the soap providing portion to easily replace the foaming member and then to achieve the effect of easy construction.

5 Claims, 6 Drawing Sheets

FOAMED SOAP DISPENSING STRUCTURE

BACKGROUND OF THE INVENTION

1. Field of the Invention

The present invention relates to a foaming unit of a foamed soap dispensing structure, and more particularly to a foaming unit capable for providing to more easily replace and quickly foam.

2. Description of the Prior Art

The conventional foam soap dispenser is using a motor to pump the liquid soap received in a container and then the liquid soap is transmitted to an outlet of a faucet by a pipeline to flow out. But the arrangement of the motor pumped the liquid soap is usually unable to make the liquid soap flow out smoothly.

The reasons are described as follows.

Firstly, the diameter of each particle of the liquid soap is too larger so that the outlet of the faucet is clogged.

Secondly, the liquid soap is unavoidable to be clogged the foaming unit after being used for a long period time.

Besides, the conventional foam soap dispenser has following drawbacks. Because the foaming unit is directly engaged with the outlet of the faucet, the foaming unit must be disassembled first by a tool, such as a wrench, while replacing. And then, the foaming unit is clipped by a clip to replace and install another faucet. The process of construction is too complicated and inconvenient.

SUMMARY OF THE INVENTION

In order to solve above mentioned drawbacks, a foamed soap dispensing structure comprises a container, receiving a liquid soap thereinside and having a soap outlet portion; a cover set, at least having two cases, a first motor, a first pipeline, a second motor, and a second pipeline, the two cases are detachably assembled to a peripheral of the soap outlet portion, the first motor and the first pipeline are fluidly communicated with each other and arranged in the two cases, and the first motor is electrically driven to pump the soap liquid, the second motor and the second pipeline are fluidly communicated with each other and arranged in the two cases, the second motor is electrically driven to pump the air to pressure a surface of the liquid soap; and a faucet, arranged at the soap outlet portion and having a soap providing portion which provides the pressured soap liquid to flow out, and the soap providing portion has a connection end;

the foamed soap dispensing structure characterized in that a foaming unit is further comprised and has a foaming member and an outer ring, the foaming member has two inlets and a foam material, the two inlets are respectively corresponding to the first pipeline and the second pipeline, the foam material is arranged at an inner space of the foaming member to provide a foam to the liquid soap mixed with the air, the outer ring has an assembling end corresponding to the connection end of the soap providing portion;

wherein when the foaming unit is clogged, the foaming unit may be pulled out by an user so that the assembling end may be separated from the connection end of the soap providing portion to easily replace the foaming member and then to achieve the effect of easy construction.

The foamed soap dispensing structure may further comprise a sensing unit, when the sensing unit detects a hand of the user, the first motor and the second motor are activated so that the pressured liquid soap is pumped to flow through the soap providing portion.

In some embodiments, the connection end of the soap providing portion is an outer thread and the assembling end of the outer ring is an inner thread, the outer thread and the inner thread are screwed with each other directly.

In some embodiments, the connection end of the soap providing portion is an outer thread and the assembling end of the outer ring is an inner thread, the outer thread and the inner thread are screwed with each other through a screw.

In some embodiments, the connection end of the soap providing portion is a first magnetic hook and the assembling end of the outer ring is a second magnetic hook, the first magnetic hook and the second magnetic hook are attracted with each other with a magnetic force.

Further objectives and advantages of the present invention will become apparent from a careful reading of the detailed description provided hereinbelow, with appropriate reference to the accompanying drawings.

DETAILED DESCRIPTION OF THE PREFERRED EMBODIMENT

Figure 1:
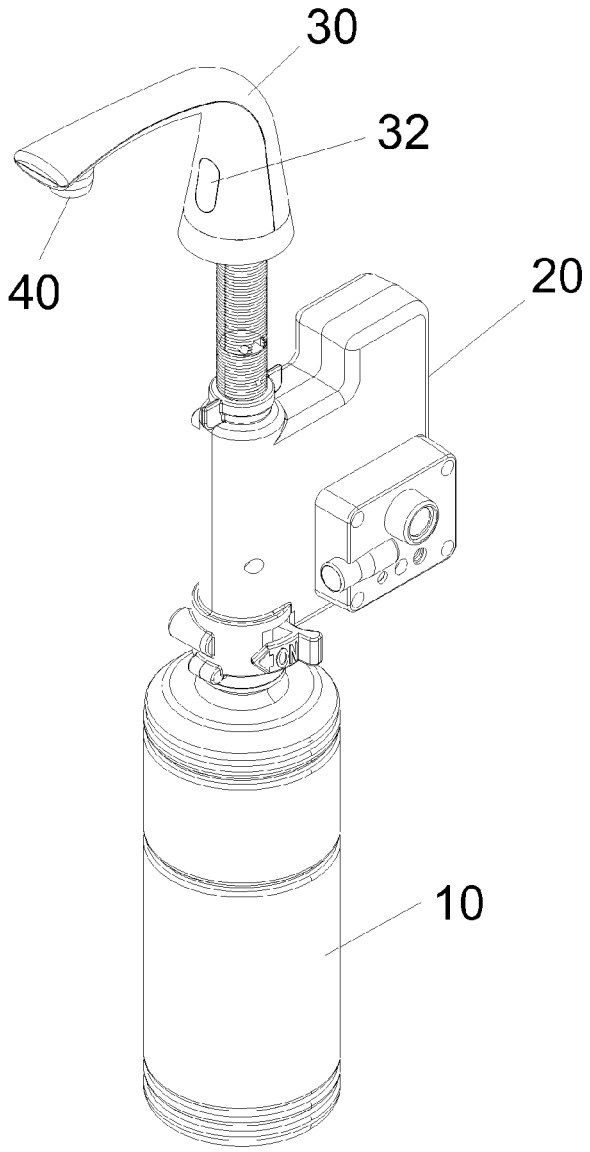
FIG. 1 is a perspective view of a soap foam dispensing structure in accordance with the present invention.

To describe clearly that the present invention achieves the foregoing objective and function, the technical features and desired function are described with reference to a preferred embodiment and accompanying drawings.

Please refer to FIGS. 1-6, a soap foam dispensing structure may mainly comprise a container 10, a cover set 20, a faucet 30, and a foaming unit 40.

The container 10 may receive a liquid soap thereinside and have a soap outlet portion 11.

The cover set 20 at least has two cases 21, a first motor 22, a first pipeline 221, a second motor 23, and a second pipeline 231. The two cases 21 are detachably assembled to a peripheral of the soap outlet portion 11. The first motor 22 and the first pipeline 221 are fluidly communicated with each other and arranged in the two cases 21. The first motor 22 is electrically driven to pump the soap liquid. The second motor 23 and the second pipeline 231 are fluidly communicated with each other and arranged in the two cases 21. The second motor 23 is electrically driven to pump the air to pressure a surface of the liquid soap received in the container 10.

The faucet 30 is arranged at the soap outlet portion 11 and has a soap providing portion 31 which is provided the pressured soap liquid to flow out. And the soap providing portion 31 has a connection end 311.

The foaming unit 40 is arranged under the soap providing portion 31 and has a foaming member 41 and an outer ring 42. The foaming member 41 has two inlets 411 and a foam material 412. The two inlets 411 are respectively corresponding to the first pipeline 221 and the second pipeline 231. The foam material 412 is arranged at an inner space of the foaming member 41 to provide a foam to the liquid soap mixed with the air. The outer ring 42 has an assembling end 421 corresponding to the connection end 311 of the soap providing portion 31. Therefore, when the foaming unit 40 is clogged, the foaming unit 40 may be pulled out by an user so that the assembling end 421 may be separated from the connection end 311 of the soap providing portion 31 to easily replace the foaming member 41 and then to achieve the effect of easy construction.

In conclusion, the effects and the advantages of the foamed soap dispensing structure of the present invention are described as follows.

Firstly, the container 10 is mainly used for providing the liquid soap. And an upper end of the container 10 is arranged the soap outlet portion 11.

Secondly, the two cases 21 of the cover set 20 respectively have a clipping portion and a control board. The clipping portion is clipped at a peripheral of the soap outlet portion and the control board is electrically connected to the first motor 22 and the second motor 23. The control board may be also electrically connected to the mains supply and/or battery holder (not shown).

Thirdly, the faucet 30 has a sensing unit 32. When the sensing unit 32 is detected a hand of the user, the second motor 23 and the first motor 22 are activated so that the pressured liquid soap pressured by the second motor 23 may be pumped by the first motor 22 to flow out through the soap providing portion 31.

Fourthly, please refer to FIGS. 1-6, the foaming unit 40 is arranged under the soap providing portion 31 and has the foaming member 41 and the outer ring 42. The foaming member 41 has two inlets 411 and the foam material 412. The two inlets 411 are respectively corresponding to the first pipeline 221 and the second pipeline 231. The foam material 412 is arranged at the inner space of the foaming member 41 to provide the foam to the liquid soap mixed with the air. The outer ring 42 has an assembling end 421 corresponding to the connection end 311 of the soap providing portion 31.

Figure 2:
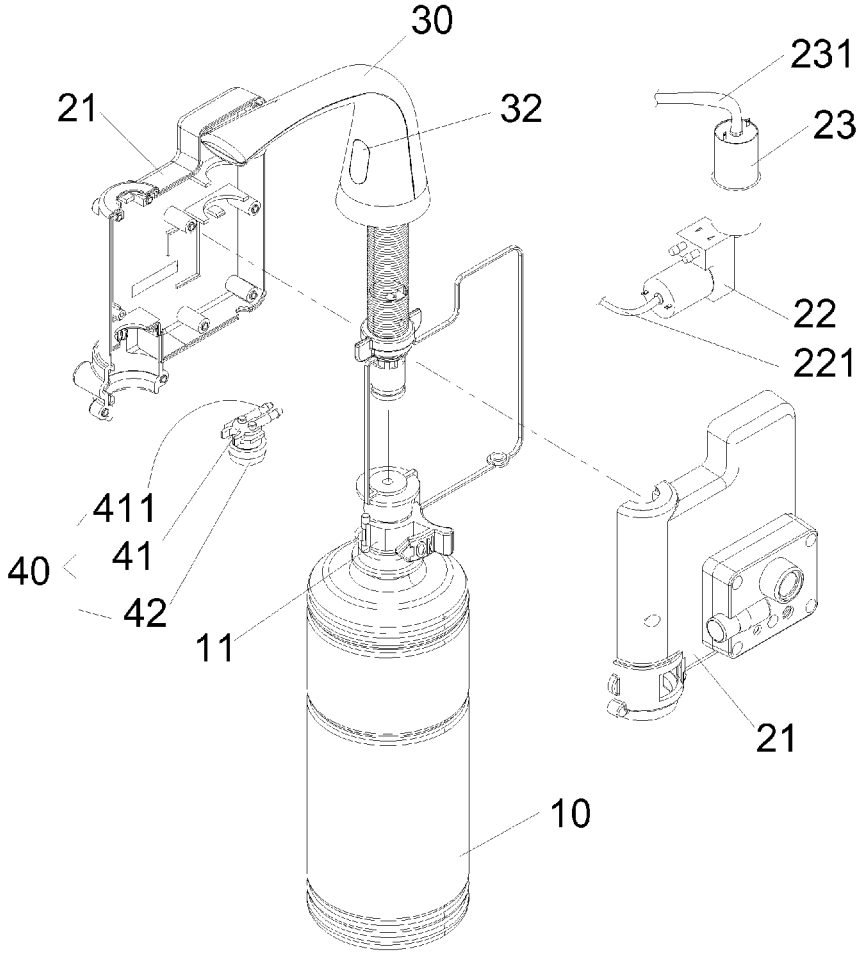
FIG. 2 is an exploded view of the soap foam dispensing structure in accordance with the present invention.
Figure 3:
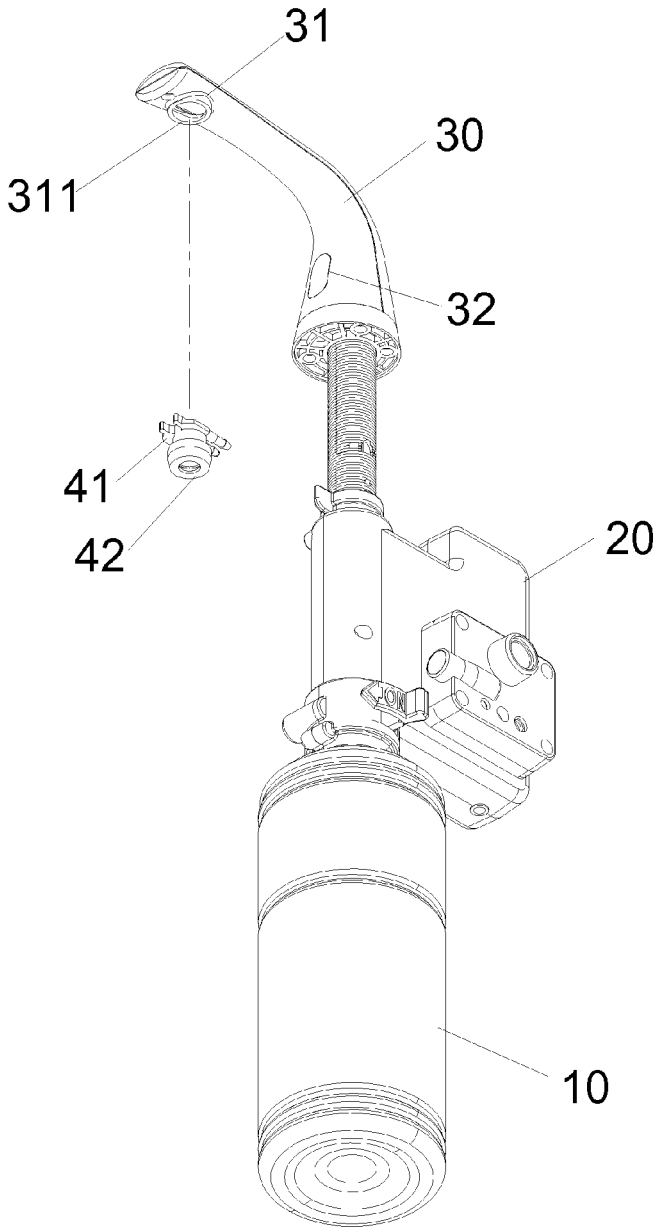
FIG. 3 is a partial exploded view of the soap foam dispensing structure in accordance with the present invention.
Figure 4:
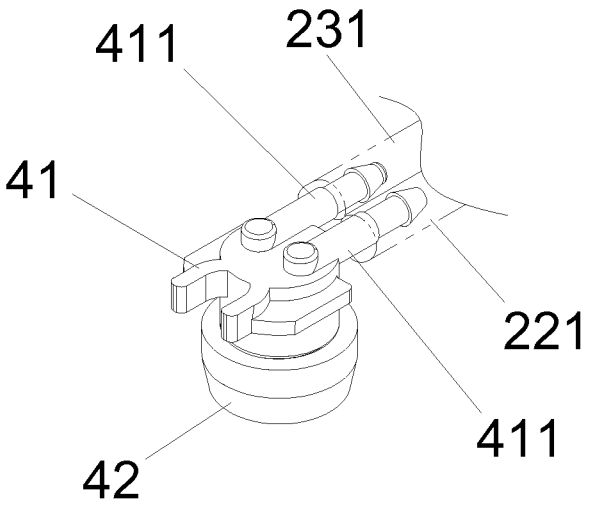
FIG. 4 is a perspective view of a foaming unit of the soap foam dispensing structure in accordance with the present invention.
Figure 5:
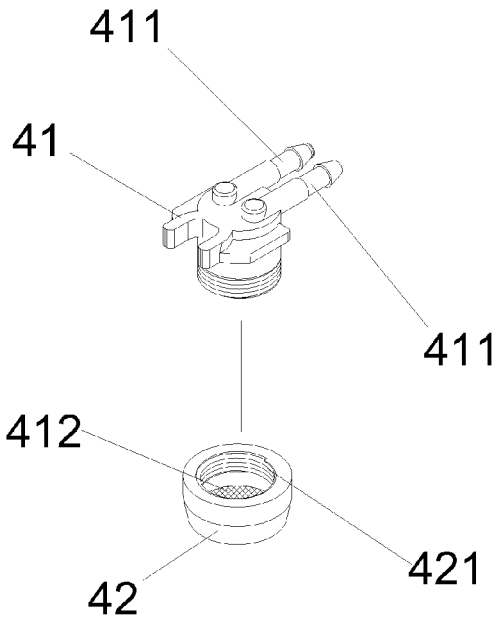
FIG. 5 is an exploded view of a foaming unit of the soap foam dispensing structure in accordance with the present invention.
Figure 6:
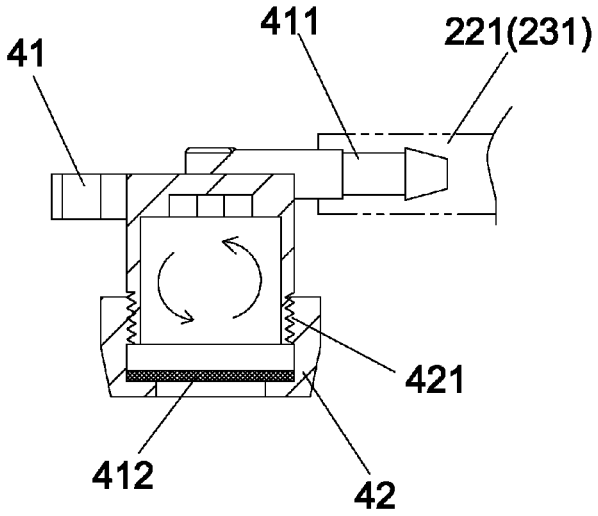
FIG. 6 is a cross-sectional view of the foaming unit of the soap foam dispensing structure in accordance with the present invention.

Fifthly, please refer to FIGS. 1 and 2, when the sensing unit 32 is detected a hand of the user, the second motor 23 and the first motor 22 are activated so that the pressured liquid soap pressured by the second motor 23 may be pumped by the first motor 22 to flow out through the soap providing portion 31. After the pressured liquid soap is flowed through the foaming unit 40, the foam is denser and finer.

Sixthly, when the foaming unit 40 is clogged, the foaming unit 40 may be pulled out by an user so that the assembling end 421 may be separated from the connection end 311 of the soap providing portion 31 to easily replace the foaming member 41 and then to achieve the effect of easy construction.

According to above descriptions, the foamed soap dispensing structure of the present invention may have some embodiments as follows.

The first embodiment is that the connection end 311 of the soap providing portion 31 is an outer thread and the assembling end 421 of the outer ring 42 is an inner thread. The outer thread and the inner thread are screwed with each other directly or through a screw.

The second embodiment is that the connection end 311 of the soap providing portion 31 is a first magnetic hook and the assembling end 421 of the outer ring 42 is a second magnetic hook. The first magnetic hook and the second magnetic hook are attracted with each other with a magnetic force.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

We claim:

1. A foamed soap dispensing structure, comprising:

a container, receiving a liquid soap thereinside and having a soap outlet portion;

a cover set, at least having two cases, a first motor, a first pipeline, a second motor, and a second pipeline, the two cases are detachably assembled to a peripheral of the soap outlet portion, the first motor and the first pipeline are fluidly communicated with each other and arranged in the two cases, and the first motor is electrically driven to pump the soap liquid, the second motor and the second pipeline are fluidly communicated with each other and arranged in the two cases, the second motor is electrically driven to pump the air to pressure a surface of the liquid soap; and a faucet, arranged at the soap outlet portion and having a soap providing portion which provides the pressured soap liquid to flow out, and the soap providing portion has a connection end;

the foamed soap dispensing structure characterized in that a foaming unit is further comprised and has a foaming member and an outer ring, the foaming member has two inlets and a foam material, the two inlets are respectively corresponding to the first pipeline and the second pipeline, the foam material is arranged at an inner space of the foaming member to provide a foam to the liquid soap mixed with the air, the outer ring has an assembling end corresponding to the connection end of the soap providing portion;

wherein when the foaming unit is clogged, the foaming unit may be pulled out by an user so that the assembling end may be separated from the connection end of the soap providing portion.

2. The foamed soap dispensing structure as claimed in claim 1, further comprising a sensing unit, when the sensing unit detects a hand of the user, the first motor and the second motor are activated so that the pressured liquid soap is pumped to flow through the soap providing portion.

3. The foamed soap dispensing structure as claimed in claim 1, wherein the connection end of the soap providing portion is an outer thread and the assembling end of the outer ring is an inner thread, the outer thread and the inner thread are screwed with each other directly.

4. The foamed soap dispensing structure as claimed in claim 1, wherein the connection end of the soap providing portion is an outer thread and the assembling end of the outer ring is an inner thread, the outer thread and the inner thread are screwed with each other through a screw.

5. The foamed soap dispensing structure as claimed in claim 1, wherein the connection end of the soap providing portion is a first magnetic hook and the assembling end of the outer ring is a second magnetic hook, the first magnetic hook and the second magnetic hook are attracted with each other with a magnetic force.

* * * * *